US010683567B2

(12) United States Patent
Prunier

(10) Patent No.: US 10,683,567 B2
(45) Date of Patent: Jun. 16, 2020

(54) CAST-IRON ALLOY, AND CORRESPONDING PART AND PRODUCTION METHOD

(71) Applicant: FERRY CAPITAIN, Vecqueville (FR)

(72) Inventor: Jean-Baptiste Prunier, Joinville (FR)

(73) Assignee: FERRY CAPITAIN, Vecqueville (FR)

( * ) Notice: Subject to any disclaimer, the term of this patent is extended or adjusted under 35 U.S.C. 154(b) by 523 days.

(21) Appl. No.: 15/511,494

(22) PCT Filed: Sep. 15, 2015

(86) PCT No.: PCT/EP2015/071109
§ 371 (c)(1),
(2) Date: Mar. 15, 2017

(87) PCT Pub. No.: WO2016/041971
PCT Pub. Date: Mar. 24, 2016

(65) Prior Publication Data

US 2017/0260608 A1 Sep. 14, 2017

(30) Foreign Application Priority Data

Sep. 15, 2014 (FR) ..... 14 58657

(51) Int. Cl.
*C22C 37/10* (2006.01)
*C22C 37/04* (2006.01)
(Continued)

(52) U.S. Cl.
CPC ..... *C22C 37/10* (2013.01); *B22D 27/04* (2013.01); *C22C 33/08* (2013.01); *C22C 37/04* (2013.01); *C22C 37/08* (2013.01); *C22C 38/002* (2013.01); *C22C 38/02* (2013.01); *C22C 38/04* (2013.01); *C22C 38/08* (2013.01); *C22C 38/10* (2013.01);
(Continued)

(58) Field of Classification Search
CPC ..... C22C 37/10; C22C 37/08; C22C 33/08; C22C 38/60; C22C 38/56; C22C 38/52; C22C 38/42; C22C 38/34; C22C 38/105; C22C 38/10; C22C 38/08; C22C 38/04;
(Continued)

(56) References Cited

U.S. PATENT DOCUMENTS 5,403,547 A * 4/1995 Smith ..... C22C 30/00 420/447
6,110,305 A * 8/2000 Nishimura ..... B24B 37/00 148/540
(Continued)

OTHER PUBLICATIONS

"Ceramvar alloy", Internet Citation, 2010, pp. 1-4, XP002740387, Retrieved from the Internet: URL:www.ectrade.com/Auction/FreeSample/1888590627 [retrieved on Jun. 2, 2015] the whole document.

(Continued)

*Primary Examiner* — John A Hevey
(74) *Attorney, Agent, or Firm* — B. Aaron Schulman, Esq.; Stites & Harbison, PLLC

(57) ABSTRACT

This spheroidal graphite or flake graphite cast-iron alloy in weight % comprises the following elements: Carbon (C) between 1.2% and 3.5%, Silicon (Si) between 1.0% or 1.2% and 3%, Nickel (Ni) between 26% and 31%, Cobalt (Co) between 15% and 20%, the remainder being Iron and inevitable impurities.
Application to the production of tooling.

20 Claims, 1 Drawing Sheet

(51) Int. Cl.

| | |
|---|---|
| ***C22C 38/34*** | (2006.01) |
| ***C22C 38/52*** | (2006.01) |
| ***C22C 38/42*** | (2006.01) |
| ***C22C 38/04*** | (2006.01) |
| ***C22C 38/08*** | (2006.01) |
| ***C22C 38/02*** | (2006.01) |
| ***C22C 38/10*** | (2006.01) |
| ***C22C 38/00*** | (2006.01) |
| ***C22C 33/08*** | (2006.01) |
| ***C22C 38/60*** | (2006.01) |
| ***C22C 38/56*** | (2006.01) |
| ***B22D 27/04*** | (2006.01) |
| ***C22C 37/08*** | (2006.01) |

(52) U.S. Cl.
CPC ..... *C22C 38/105* (2013.01); *C22C 38/34* (2013.01); *C22C 38/42* (2013.01); *C22C 38/52* (2013.01); *C22C 38/56* (2013.01); *C22C 38/60* (2013.01)

(58) Field of Classification Search
CPC ..... C22C 38/02; C22C 38/002; C22C 37/04; B22D 27/04
See application file for complete search history.

(56) References Cited

U.S. PATENT DOCUMENTS

2005/0064219 A1 3/2005 Fraisse et al.
2010/0102910 A1 4/2010 Waeckerle et al.

OTHER PUBLICATIONS

"Import Stainless Steel", Internet Citation, 2010, pp. 1-4, XP002740388, Retrieved from the Internet: URL:www.tradezz.com/buy_6560338 _kovar.htm [retrieved on Jun. 2, 2015] the whole document.
International Search Report for PCT/EP2015/071109, dated Oct. 28, 2015.
Written Opinion of the International Searching Authority for PCT/EP2015/071109, dated Oct. 28, 2015.
Preliminary Search Report for FR 1458657, completed Jun. 9, 2015.

* cited by examiner

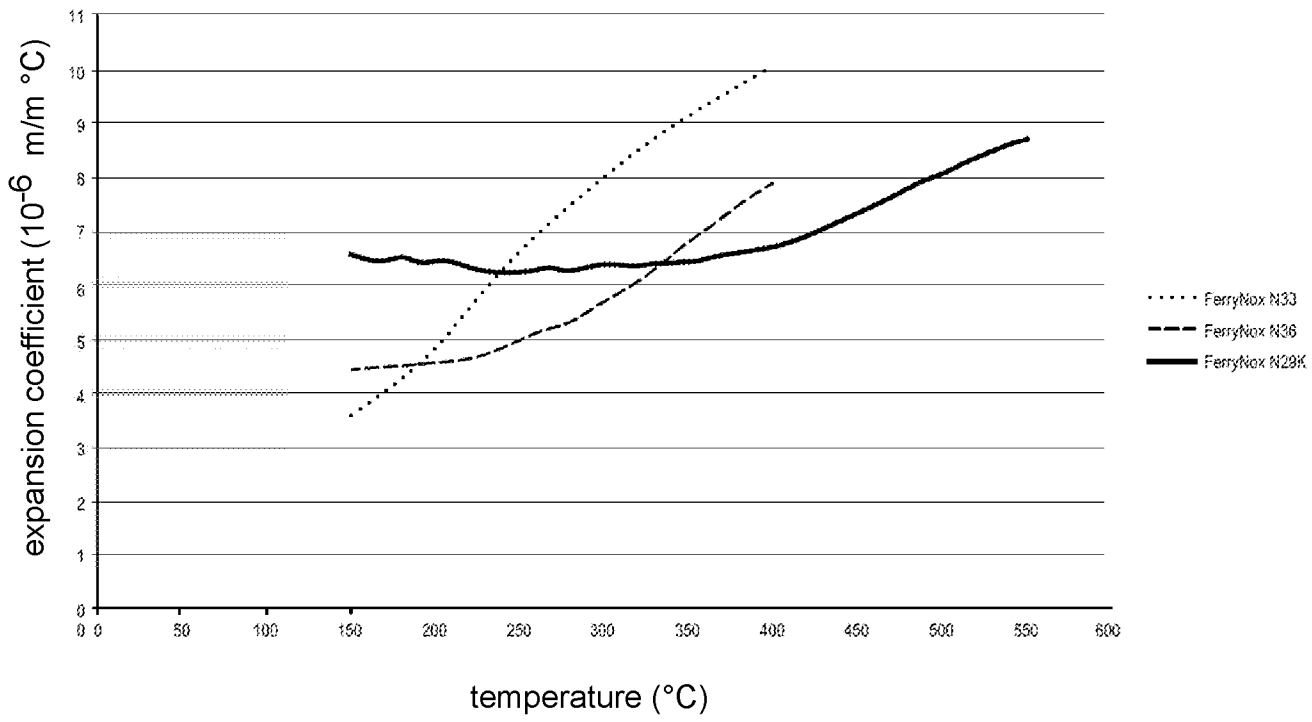
FerryNox N33
FerryNox N36
FerryNox N29K
expansion coefficient ($10^{-6}$ m/m °C)
temperature (°C)
0
1
2
3
4
5
6
7
8
9
10
11
0
50
100
150
200
250
300
350
400
450
500
550
600

CAST-IRON ALLOY, AND CORRESPONDING PART AND PRODUCTION METHOD

The present invention relates to a cast-iron alloy.

In the state of the art, cast-iron tooling is known for the manufacture of parts in composite carbon fibre and resin material or in thermoplastic material. These parts in carbon/resin composite material are moulded at a temperature of generally up to 250° C.

The tooling must have a low thermal expansion coefficient or a thermal expansion coefficient close to that of the material or matter to be moulded, over the temperature range used for forming.

For forming temperatures above 250° C., existing tools are solely mechanically welded.

For forming temperatures of up to 250° C. using cast-iron tooling, there are a certain number of alloys having an acceptable thermal expansion coefficient, which is not the case for higher temperatures.

In particular, some thermoplastic materials (e.g. polyimides) and composites containing these same thermoplastics require higher temperatures. By increasing the forming temperature, it also becomes possible in some cases to reduce the length of a production cycle.

At the current time, cast metal alloys are available for tooling which allow a stable thermal expansion coefficient to be maintained up to 250° C. Sheet metals also exist allowing a stable expansion coefficient to be maintained up to 400° C.

Tooling in steel is also known used for the manufacture parts in composite material or thermoplastic material. However, the walls of this tooling are relatively thick since steel is likely to contain structural defects (shrinkage cavities) when used to produce tooling of narrow thickness.

It is the objective of the invention to allow the production by moulding of a cast-iron part having low thermal expansion at high temperatures and in particular at up to 400° C., this expansion coefficient remaining stable up to these high temperatures.

In particular, the objective of the invention is to design an alloy which allows the production of tooling having a low, stable expansion coefficient, including at high temperatures. The invention therefore sets out to design an alloy which allows the production of said tooling with narrow wall thickness, whilst ensuring that it has few structural defects.

For this purpose, the subject of the invention is a spheroidal graphite or flake graphite cast-iron alloy comprising the following elements in weight %: Carbon (C) between 1.2% and 3.5%, Silicon (Si) between 1.0% or 1.2% and 3%, Nickel (Ni) between 26% and 31%, Cobalt (Co) between 15% and 20%. Optionally the alloy comprises: Magnesium (Mg) between 0.02% and 0.10%, Manganese (Mn)≤1.5%, Chromium (Cr)≤0.5%, and/or Phosphorus (P)≤0.12 or ≤0.04%, and/or Sulfur (S)≤0.11 or ≤0.03%, and/or Molybdenum (Mo)≤0.5%, and/or Copper (Cu)≤0.5%, the remainder being Iron and inevitable impurities.

According to particular embodiments, the alloy may have one or more of the following characteristics:

- the Nickel (Ni) content is at least 27% or 28% and/or no more than 30%;
- the Cobalt (Co) content is at least 16% and/or no more than 18% or 19%;

- the alloy comprises Carbon (C) in at least 1.4% or 1.5% and no more than 3.1% or 3.3%, and/or Silicon (Si) in at least 1.4% or 1.5% and no more than 2.6% or 2.8%;
- the Manganese (Mn) content is at least 0.01% and/or no more than 1.0%;
- the Copper (Cu) content is no more than 0.2%, 0.3% or 0.4%;
- the Molybdenum (Mo) content is no more than 0.2%, 0.3% or 0.4%;
- the Chromium (Cr) content is no more than 0.3%, 0.4% or 0.5%.

A further subject of the invention is a part produced in a cast-iron alloy such as defined above, the part particularly being a tool.

The invention also concerns a method to produce a part such as defined above, characterized in that it comprises the following steps:

Casting the part in a mould;

Once cast in the mould, the part is subjected to cooling in the mould, this cooling being below 50° C./h.

The invention will be better understood on reading the following description, given solely as an example and with reference to the single FIGURE illustrating the thermal expansion behaviour of three alloys via changes in their thermal expansion coefficient as a function of temperature.

The subject of the invention is a cast-iron alloy. It allows the production of parts having a low, stable thermal expansion coefficient at temperatures of up to 400° C.

For example, the part is a tool and in particular a tool to manufacture parts in composite material or thermoplastic material.

All the indications given in the remainder hereof regarding composition are in weight % of the total weight of the alloy.

A first aspect of the invention is the chemical composition of the alloy.

The alloy is a cast-iron alloy. The alloy may be a spheroidal graphite or flake graphite cast-iron alloy.

Its basic component is Iron (Fe). It also comprises inevitable manufacturing impurities.

In addition to Fe, the alloy contains Carbon (C) between 1.2% and 3.5%, Silicon (Si) between 1% and 3%, Nickel (Ni) between 26% and 31% and Cobalt (Co) between 15% and 20%.

In addition, the alloy may comprise Magnesium (Mg) between 0.02% and 0.10%.

In addition, the alloy may comprise Manganese (Mn) up to 1.5%, or up to 0.8%.

In addition, the alloy may comprise Chromium (Cr), at a content between traces and 0.5%.

In addition, the alloy may comprise Phosphorus (P), at a content between traces and 0.04% or between traces and 0.12%.

In addition, the alloy may comprise Sulfur (S), at a content between traces and 0.03% or between traces and 0.11%.

In addition, the alloy may comprise Molybdenum (Mo), at a content between traces and 0.5%.

In addition, the alloy may comprise Copper (Cu), at a content of between traces and 0.5%.

The Nickel (Ni) content of the alloy may preferably be between at least 27% or 28% and no more than 30%.

The Cobalt (Co) content of the alloy may preferably be between at least 16% and no more than 18% or 19%.

The Carbon (C) content of the alloy may preferably be between at least 1.4% or 1.5%, and no more than 3.1% or 3.3%.

The Silicon (Si) content of the alloy may preferably be between at least 1.4% or 1.5% and no more than 2.6% or 2.8%.

The Manganese (Mn) content of the alloy may preferably be between at least 0.01% and/or no more than 1.0%.

The Copper (Cu) content of the alloy may preferably be lower than 0.2%, 0.3% or 0.4%.

The Molybdenum (Mo) content of the alloy may preferably be lower than 0.2%, 0.3% or 0.4%.

An iron-based alloy is known having a low expansion coefficient i.e. Fe—Ni36 (trade name INVAR®). It is a steel developed at the end of the XIX century. It contains 36% nickel and iron. The curve representing the expansion coefficient of iron/nickel alloys exhibits an anomaly in the region of 36% nickel: the expansion coefficient is much lower than for other compositions. This is valid for low temperatures of up to 130° C.

Various alloys were later developed from this base, in particular with cobalt as addition element. For example, the iron/nickel/cobalt alloy with 32% nickel and 5.5 cobalt has a lower expansion coefficient than INVAR®, and above all it maintains this property at higher temperatures.

Cast iron exhibits the same anomaly as steel, however the expansion coefficient is a little higher. Ni-Resist D5 (ASTM A439) with 35% nickel (remainder iron) particularly has a low expansion coefficient: $5*10^{-6}$ $K^{-1}$.

As was the case with steel, other alloys were subsequently developed by adding addition elements such as cobalt. For example, Ferrynox N33 ® (33% nickel, 4% cobalt) allows a low expansion coefficient to be obtained ($4*10^{-6}$ $K^{-1}$) with stability up to 180° C. Ferrynox N36 ® (36% nickel, 4% cobalt) has a higher expansion coefficient ($4,5*10^{-6}K^{-1}$), that remains stable however up to 250° C. The shape of the curves displayed by the thermal expansion coefficient of the two alloys FerrynoxN36 and FerrynoxN33 as a function of temperature are illustrated in the single FIGURE.

For each example, the alloy—aside from iron (Fe) and inevitable impurities—comprises solely the following elements within the indicated limits:

| | C | Si | Mn | P | S | Cr | Ni | Mo | Cu | Mg | Co |
|---|---|---|---|---|---|---|---|---|---|---|---|
| Mini | 1.2 | 1.2 | traces | traces | traces | traces | 26 | traces | traces | 0.02 | 15 |
| Maxi | 3.5 | 3 | 1.5 | 0.04 | 0.03 | 0.5 | 31 | 0.5 | 0.5 | 0.1 | 20 |
| Example 1 | 1.9 | 1.64 | 0.12 | 0.014 | traces | 0.03 | 29.44 | traces | 0.017 | 0.06 | 16.96 |
| Example 2 | 1.9 | 1.63 | 0.12 | 0.014 | 0.006 | 0.03 | 29.06 | 0.002 | 0.02 | 0.04 | 17.49 |

This alloy is a spheroidal graphite cast-iron.

The thermal expansion coefficient in Example 1, indicated under the name Ferrynox N29K in the FIGURE, as compared with the thermal expansion coefficients of the two prior art alloys (Ferrynox N33 and Ferrynox N36) is shown in the single FIGURE.

The thermal expansion coefficient of Example 1 is lower than $6.4*10^{-6}$ $K^{-1}$ at a temperature lower than 400° C. Also, the thermal expansion coefficient is relatively stable over a wide temperature range. It is between $6*10^{-6}$ $K^{-1}$ and $7*10^{-6}$ $K^{-1}$ over the entire range of 150° C. to 400° C.

The mechanical characteristics of the sample are the following:

| | Yield point Re (MPa) | Ultimate tensile strength Rm (MPa) | Elongation at failure A % |
|---|---|---|---|
| at 20° C. | 298 | 483 | 28.4 |
| at 200° C. | 214 | 380 | 29.8 |
| at 300° C. | 146 | 350 | 30 |
| at 400° C. | 166 | 341 | 30.5 |
| at 450° C. | 156 | 336 | 30.9 |

A further aspect of the alloy of the invention is that it can be welded.

According to another embodiment, the alloy—in addition to iron (Fe) and inevitable impurities—comprises solely the following elements within the indicated limits:

| | C | Si | Mn | P | S | Cr | Ni | Mo | Cu | Co |
|---|---|---|---|---|---|---|---|---|---|---|
| Mini | 1.2 | 1 | traces | traces | traces | traces | 26 | traces | traces | 15 |
| Maxi | 3.5 | 3 | 1.5 | 0.12 | 0.11 | 0.5 | 31 | 0.5 | 0.5 | 20 |
| Example | 1.9 | 1.7 | 0.45 | 0.04 | 0.07 | 0.03 | 28.96 | 0.002 | 0.02 | 17.54 |

In this case, the alloy is a flake graphite cast iron.

A second aspect of the invention is a part manufactured in an alloy such as defined above. The part is particularly a tool. The tool may only comprise portions in the alloy of the invention or it may be entirely formed of this alloy. In general, at least the formed surface of the tool is composed of the alloy of the invention.

Preferably, the minimum wall thickness of the tool is less than 50 mm.

A third aspect of the invention is the method to produce a part in an alloy of the invention.

The part e.g. a tool is first cast in a mould.

Once cast in the mould, the part undergoes cooling, especially slow cooling in the mould. The term <<slow>> means lower than 50° C./h, in particular throughout the entire cooling time between casting of the part and solidification.

After the cooling step, the part can be heat treated e.g. annealed.

The alloy is especially used to produce tooling subsequently used for the manufacture of composite parts e.g. in thermoplastic material and carbon fibres. The technical field may relate to aeronautics.

According to other aspects of the invention, the alloy may have one of more of the following contents:

Silicon (Si) between 1.2% and 3%, and/or
Phosphorus (P) 0.04%, and/or
Sulfur (S) 0.03%.

The invention claimed is:

1. Spheroidal graphite or flake graphite cast-iron alloy consisting of the following elements in weight %:

Carbon (C) between 1.2% and 3.5%,
Silicon (Si) between 1.4% and 3%,
Nickel (Ni) between 26% and 31%,
Cobalt (Co) between 15% and 20%,
Magnesium (Mg) between 0.02% and 0.10%,
Manganese (Mn)≤1.5%,
Chromium (Cr)≤0.5%, and/or
Phosphorus (P)≤0.12, and/or
Sulfur (S)≤0.11, and/or
Molybdenum (Mo)≤0.5%, and/or
Copper (Cu)≤0.5%,
the remainder being Iron and inevitable impurities.

2. The alloy according to claim 1, wherein the Nickel (Ni) content is at least 27%.

3. The alloy according to claim 1, wherein the Nickel (Ni) content is no more than 30%.

4. The alloy according to claim 1, wherein the Cobalt (Co) content is at least 16%.

5. The alloy according to claim 1, wherein the Cobalt (Co) content is no more than 19%.

6. The alloy according to claim 1, wherein the alloy comprises at least 1.4% Carbon (C).

7. The alloy according to claim 6, wherein the alloy comprises no more than 3.3% Carbon (C).

8. The alloy according to claim 1, wherein the alloy comprises at least 1.5% Silicon (Si).

9. The alloy according to claim 8, wherein the alloy comprises no more than 2.8% Silicon (Si).

10. The alloy according to claim 1, wherein the content of Manganese (Mn) is at least 0.01% and no more than 1.0%.

11. The alloy according to claim 1, wherein the content of Copper (Cu) is no more than 0.4%.

12. The alloy according to claim 11, wherein the content of Copper (Cu) is no more than 0.3%.

13. The alloy according to claim 12, wherein the content of Copper (Cu) is no more than 0.2%.

14. The alloy according to claim 1, wherein the content of Molybdenum (Mo) is no more than 0.4%.

15. The alloy according to claim 1, wherein the content of Chromium (Cr) is less than 0.5%.

16. A part produced in a cast-iron alloy, characterized in that the alloy is an alloy according to claim 1.

17. The part of claim 16, wherein the part is a tool.

18. A method to produce a part according to claim 16, comprising:

casting the part in a mould, and
once the part is cast in the mould, subjecting the part to cooling in the mould.

19. The method according to claim 18, wherein cooling the part in the mould is cooling at a rate below 50° C./h.

20. The alloy according to claim 1, wherein the range of thermal expansion coefficient of the alloy is between $6*10^{-6}$ $K^{-1}$ and $7*10^{-6}$ $K^{-1}$ over the entire range of 150° C. to 400° C.

* * * * *